US006445124B1

(12) United States Patent
Asai et al.

(10) Patent No.: US 6,445,124 B1
(45) Date of Patent: Sep. 3, 2002

(54) FIELD EMISSION DEVICE

(75) Inventors: Hironori Asai; Masahiko Yamamoto; Koji Suzuki, all of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 109 days.

(21) Appl. No.: 09/654,708

(22) Filed: Sep. 1, 2000

(30) Foreign Application Priority Data

Sep. 30, 1999 (JP) ..... 11-280666

(51) Int. Cl.[7] ..... H01J 1/62

(52) U.S. Cl. ..... 313/495; 313/309; 313/310; 313/336

(58) Field of Search ..... 313/495, 496, 313/309, 310, 336, 351

(56) References Cited

FOREIGN PATENT DOCUMENTS

JP 8-250018 9/1996
JP 8-293244 11/1996
JP 9-082215 3/1997

OTHER PUBLICATIONS

Tae–Young Ko, et al., "Fabrication and Simulation of a Gated Thin Film Emitter," J. Vac. Sci. Technol. B 16(2), Mar./Apr. 1998, pp. 700–704.

*Primary Examiner*—Vip Patel
(74) *Attorney, Agent, or Firm*—Oblon, Spivak, McClelland, Maier & Neustadt, P.C.

(57) ABSTRACT

A field emission device essentially consists of three electrodes, and comprises a cathode on the surface of which an emissive material is formed, a gate electrode formed on an insulation layer formed to upwardly surround the cathode, and having an opening for passing electrons emitted from the emissive material, and an anode for accelerating the electrons passing through the opening, wherein L/S is one or above, where S represents an aperture diameter of the opening, and L represents a typical shortest distance that the electrons emitted from the emissive material take to pass through the insulation layer surrounding the cathode. Based on this structure, it is possible to provide a field emission device that can control the orbit of emitted electrons while employing a simple three-electrode structure.

17 Claims, 5 Drawing Sheets

| Lg/L | BRIGHTNESS |
|---|---|
| 0.75～1.0 | DARK |
| 0.5～0.75 | BRIGHT |
| 0.25～0.5 | BRIGHTER |
| 0.0～0.25 | BRIGHTEST |

FIELD EMISSION DEVICE

CROSS-REFERENCE TO RELATED APPLICATIONS

This application is based upon and claims the benefit of priority from the prior Japanese Patent Application No. 11-280666, filed Sep. 30, 1999, the entire contents of which are incorporated herein by reference.

BACKGROUND OF THE INVENTION

The present invention relates to a field emission device, and relates, more particularly, to a field emission device having a three-electrode structure of a cathode, an anode and a gate electrode.

There have been proposed various field emission type cold cathodes. Among others, a tip emitter called a Spindt type emitter and a surface conduction emitter are representative types. In recent years, a method using a carbon nanotube that is stable with a low work function has also been proposed.

FIG. 1 shows a cross section of a tip emitter. This emitter has a sharp front end of a tip emitter 170 formed on a cathode 120, with the front end having a curvature radius of a few nanometers to a few dozens of nanometers. The tip emitter emits cold electrons based on a strong electric field that is concentrated at the front end. In other words, an electric field is formed between the front end of the emitter 170 and a gate electrode 140 formed on a first insulation layer 130 on the cathode 120, and electrons are emitted from the front end of the tip emitter 170. Therefore, in order to emit electrons at a low voltage, it is ideal to set a distance between the gate electrode 140 and the emitter 170 as short as possible. The emitted electrons are drawn to a direction of an anode (not shown) disposed above the tip emitter 170. However, each electron has an initial speed in a horizontal direction at the time of the emission, and therefore, the electron beams are spread in a lateral direction.

In order to prevent this spread of the electron beams, a control electrode 160 is disposed above the gate electrode 140 as shown in FIG. 1. In this case, it is necessary that an aperture diameter of the gate electrode 140 and an aperture diameter of the control electrode 160 are set to have a suitable ratio. In order to install the control electrode 160, it is necessary to install an insulation layer 150 on the gate electrode 140 and then to install the control electrode 160 on the insulation layer 150. In order to implement this installation process, a high-precision aligner is necessary. Therefore, this has a drawback in that not only the installation process increases, but also the facility necessary for the manufacturing becomes expensive.

In the mean time, in the case of the surface conduction emitter, an electron emitter is provided on a conductive thin film that extends over a pair of electrodes (an emitter electrode and a gate electrode) that are formed on a substrate. When an electric field is applied to the electrodes on both ends of the electron emitter, electrons are drawn out in a horizontal direction from an emitter electrode, and force is applied to the gate electrode provided on the substrate. Thus, the electrons are emitted in a horizontal direction. An acceleration electrode is provided above the electron emitter, and a part of the emitted electrons fly to the acceleration electrode. However, this efficiency is low, and the electrons are emitted in a parabolic direction in stead of a vertical direction from the substrate. Therefore, the electrons that collide against the acceleration electrode are deviated from the normal line of the electron emitter. Because of this phenomenon, when the field emitter is applied to an image display unit, beams are dispersed. As a result, there occurs a leakage of beams to adjacent pixels, or a high-efficient light emission is not obtained.

FIG. 2 is a perspective view showing one example of a surface conduction emitter disclosed in Jpn. Pat. Appln. KOKAI Publication No. 8-250018. This surface conduction emitter solves the leakage of the beams to adjacent pixels by narrowing the emitted electron beams. In order to solve the above phenomenon, there are provided electrodes 122*a* and 122*b* that form an equipotential surface of approximately a U shape in a direction orthogonal with a direction of voltage application between a pair of electrodes 123*a* and 123*b*, on a surface that is defined by the direction of voltage application between the pair of electrodes 123*a* and 123*b* and a direction of an electric field application by an acceleration electrode (above the electrodes 123*a* and 123*b* not shown) that works on the emitted electrons.

However, according to the surface conduction emitter, in order to form the approximately U-shaped equipotential surface, it is necessary to set the electron emitter at the center of the device electrode, and it is also necessary to strictly adjust the device formation and the height of the wiring electrode.

In order to solve the difficulty of the above manufacturing methods, a four-electrode type field emitter has been proposed in Jpn. Pat. Appln. KOKAI Publication No. 8-293244. FIG. 3 shows the four-electrode type field emitter. The disclosed four-electrode structure consists of a cathode 131, a control electrode 134, a gate electrode 133, and an anode 136. According to this method, neither a tip emitter nor a surface conduction emitter is used, but a material of a low work function is used as an electron emission layer 135. A shape of electron beams is narrowed by the substrate (cathode) 131 on which the electron emission layer 135 has been formed, the beam-forming electrode (control electrode) 134 that has been formed on the electron emission layer 135 by surrounding the electron emission layer, and the gate electrode 133 that has been formed on an insulation layer 132 on the beam-forming electrode 134.

However, according to this emitter, it is unavoidable that the process also becomes complex as it is necessary to form the control electrode in a similar manner to that of the emitter shown in FIG. 1.

Further, Jpn. Pat. Appln. KOKAI Publication No. 9-82215 has disclosed an emitter that has a large number of field emission tips having fine sizes within the electron emission surface. Further, there has been proposed a structure that has a ratio of a distance between a gate and an emitter to an aperture diameter (short diameter) set to 1 to 2 or higher so that the large number of field emission tips can have an approximately equal opportunity of emitting electrons. Based on this structure, it has been intended to be able to drive approximately homogeneously an emitter made of a bundle of nanometer-sized wires. However, this disclosure has an object of driving approximately homogeneously the emitter made of a bundle of nanometer-sized wires. This disclosure does not intend to restrict the spreading of the orbit of electron emission. Thus, this disclosure describes that it is desirable to have a control electrode without particularly limiting the electrode structure.

As explained above, as it is difficult to control the direction of electrons emitted by the field emitter that has a three-electrode structure of a cathode, an anode and a gate electrode, it has been conventionally assumed that a four-electrode structure having a control electrode in addition to the three electrodes is necessary. However, the four-electrode structure has a complex structure around the electron emitter. Further, this structure involves a difficulty in the manufacturing aspect as the electron emitter must be installed at the center of the electric field.

BRIEF SUMMARY OF THE INVENTION

It is an object of the present invention to provide a field emission device having a three-electrode structure that can be manufactured easily and that can control the direction of emitted electrons.

In order to achieve the above object, according to a first aspect of the present invention, there is provided a field emission device consisting of three electrodes, the field emission device comprising:

an emissive material formed on a cathode on a substrate;

an insulation layer formed to surround the emissive material;

a gate electrode formed on the insulation layer and having an opening for passing electrons emitted from the emissive material; and an anode opposing to the emissive material, wherein $L/S \geqq 1$, where S represents an aperture diameter of the opening, and L represents a typical shortest passing distance of the electrons emitted from the emissive material to the gate electrode.

According to a second aspect of the invention, there is provided a field-emission type display unit essentially consisting of three electrodes, the field-emission type display unit comprising:

a substrate;

a cathode layer formed on the substrate;

an insulation layer formed on the cathode layer, and having a plurality of first openings;

a gate electrode formed on the insulation layer, and having a plurality of second openings corresponding to the plurality of first openings, each of the second openings having the same aperture diameter as that of each of the first openings;

an electron emission layer formed on the cathode layer exposed through the first and the second openings;

a transparent plate disposed to face a surface of the substrate on which the cathode layer is formed, via a frame provided on a periphery of the substrate;

an anode layer formed on a surface of the transparent plate facing the cathode layer; and a phosphor layer formed on the anode layer, wherein $L/S \geqq 1$, where S represents the aperture diameter of the plurality of first openings, and L represents a typical shortest passing distance of the electrons emitted from the emissive material to the gate electrode.

More specifically, the electron emission layer of the field emission device or the display unit of the present invention is formed at the bottom of a deep opening so that an electric field is applied to the emitted electrons in a direction approximately vertical to the electron emission layer. With this arrangement, only the electrons of which speed component is large in a direction approximately vertical to the electron emission layer pass through the opening of the gate electrode and reach the anode. Thus, it is possible to make narrow the orbit of the electrons that have passed through the opening of the gate electrode and proceed to the anode. Therefore, it is possible to control the orbit of the electrons in a three-electrode structure that does not have a control electrode. In a three-electrode structure having a simple structure, the relationship of $1>L/S \geqq 1/2$ disclosed in Jpn. Pat. Appln. KOKAI Publication No. 9-82215 cannot sufficiently function to restrict the spreading of the orbit of the electron emission. The spreading can be restricted when the relationship is set to $L/S \geqq 1$. This is a fact that has been made clear for the first time by the present inventor.

Further, it is preferable that an average surface density of the plurality of openings is set to 1 $pc/\mu m^2$ or above. According to Jpn. Pat. Appln. KOKAI Publication No. 9-82215, the homogeneity of electron emission points is improved by taking a large number of emission points within a single opening. However, based on this structure, it is difficult to decrease the variance among electron emitters having individual openings. According to the present invention, the electron emitters having individual openings are disposed closely to decrease the variance. In other words, the average surface density is set to 1 $pc/\mu m^2$ or above. With this arrangement, even if there is a variance among the volumes of electrons emitted from individual openings, the volumes of the emitted electrons can be homogenized on average. This has an effect of restricting the variance of luminance between pixels when the invention is applied to a display unit.

The opening relating to the present invention can take a circular shape, an elliptical, or a polygonal shape, and the shape is not particularly limited. The diameter of the opening is a diameter of a circle when the opening takes a circular shape (see FIG. 4A), and the diameter of the opening is a short diameter when the opening takes an elliptical (see FIG. 4B). The diameter of the opening is a diameter of an inscribed circle when the opening takes a triangular shape or a square shape (see FIGS. 4C and 4D). The diameter of the opening is a diameter of a circle that is inscribed to longer parallel sides when the opening takes a parallelogram (see FIG. 4E). In these FIGS. 4A to 4E, a reference number 6 denotes an opening.

In spite of the improved control of the spreading of electrons, a part of the electrons that pass through the opening have a speed component in a direction parallel with the electron emission layer. These electrons work to spread the orbit of electrons when they pass through the opening. However, when a relationship between a thickness of the gate electrode Lg and a typical shortest distance L is set to $Lg/L \geqq 0.75$, it is possible to restrict the spreading of the orbit of the electrons to a negligible level while securing the volume of electrons proceeding to the anode electrode when the invention is applied to a display unit or the like.

More specifically, based on the setting of the relationship of $L/S \geqq 1$, a majority of the electrons are emitted to a direction approximately vertical to the electron emission layer, and a part of electrons that have the speed component in a direction parallel with the electron emission layer are elastically scattered by the insulation layer. However, when the electron emission layer is formed at the bottom of the deep opening, the orbit of the emitted electrons in the vertical direction can be easily corrected. Further, even if electrons take a distance exceeding the shortest distance L, those electrons having the parallel component collide against the gate electrode that has a predetermined thickness, and are absorbed by the gate electrode. On the other hand, when the thickness of the gate electrode is too much, the volume of those electrons that are absorbed by the gate electrode when passing through the gate electrode increases, and it becomes impossible to secure a necessary current. Therefore, the brightness changes on the display of the display unit. In order to secure this necessary brightness, the relationship of $Lg/L \leqq 0.75$ has been set.

Further, it is preferable that the emissive material is formed on a plane on the cathode layer, and is at least one selected from Pd, Cs, $LaB_6$, graphite, carbon and diamond.

Further, it is preferable that a space formed by the substrate, the transparent plate and the frame is in vacuum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

FIGS. 5A to 5F are cross-sectional views showing stages of a method of manufacturing a field emission device (display unit) according to the present invention.

An insulation substrate 11 such as a glass substrate or a ceramic substrate is prepared. Then, a cathode layer 3 made of a conductive thin film with a film thickness of about 0.01 to 0.9 $\mu$m is formed by vacuum deposition or sputtering on this insulation substrate 11. In the present embodiment, a cathode layer of nickel having a film thickness of about 0.1 $\mu$m is formed.

The conductive material that structures the cathode layer 3 is not particularly limited to nickel, and the cathode layer can be formed using a metal like gold, silver, molybdenum, tungsten, or titanium, or a conductive oxide. Further, it is also possible to form a nickel layer via titanium or chrome layer in order to improve the adhesion strength between the insulation substrate 11 and the cathode layer 3, according to the need. A part of the cathode layer can also be used as a signal line.

The above is not the only method for forming the cathode layer 3, and it is also possible to form the cathode layer 3 by using a thick film technique or a plating method.

Next, a desired resist pattern is formed on the surface of the cathode layer 3 by aligning through a mask. Then, the cathode layer 3 is formed into a predetermined shape by etching.

Next, an insulation layer 2 made of $SiO_2$ is formed on the surface of the cathode layer 3 to have a film thickness of 0.2 $\mu$m. The sputtering method is not the only method for forming this insulation layer. The insulation layer can also be formed by a spin-on-glass (SOG) method, a liquid phase deposition (LPD) method or the like, by covering an $SiO_2$ film on the surface of the cathode layer 3 and then firing this film.

Next, a gate electrode 1 is formed on the insulation layer 2. This gate electrode 1 is also used as a signal line like the cathode layer 3, and is formed in a similar manner to that of the cathode layer 3. In the present embodiment, a gate electrode made of a nickel layer having a film thickness of about 0.1 $\mu$m is formed on the surface of the insulation layer 2 by the vacuum deposition method or by sputtering. This gate electrode can also be formed using a metal like gold, molybdenum, tungsten, or titanium, or a conductive oxide, in a similar manner to that of the cathode layer. Further, a gate electrode can be formed on the surface of the insulation layer via titanium or chrome layer according to the need.

Figure 1:
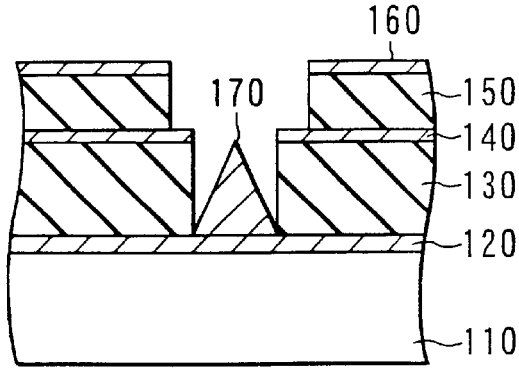
FIG. 1 PRIOR ART
FIG. 1 is a cross-sectional view showing one example of a conventional field emitter.
Figure 2:
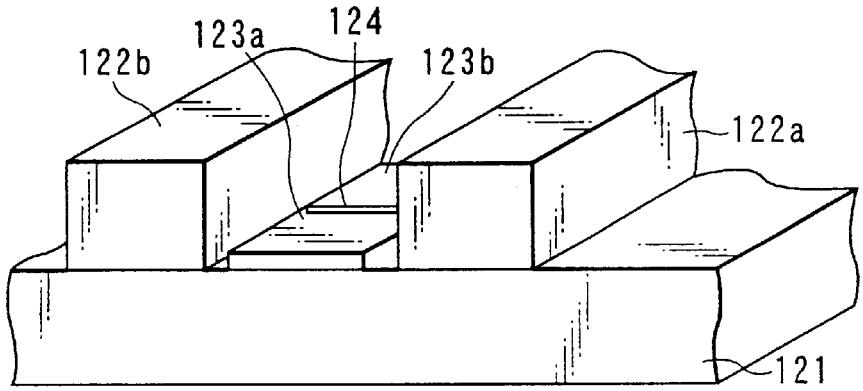
FIG. 2 PRIOR ART
FIG. 2 is a cross-sectional view showing another example of a conventional field emitter.
Figure 3:
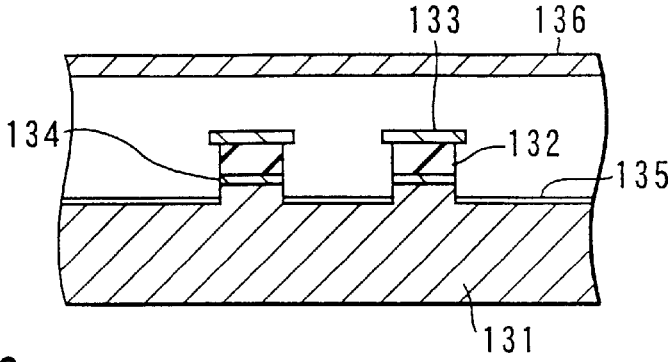
FIG. 3 PRIOR ART
FIG. 3 is a cross-sectional view showing still another example of a conventional field emitter.
Figure 4A:
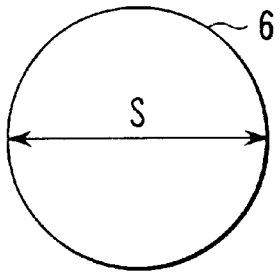
FIGS. 4A to 4E are diagrams for explaining shapes of gate openings and definitions of aperture diameters according to the present invention.
Figure 4B:
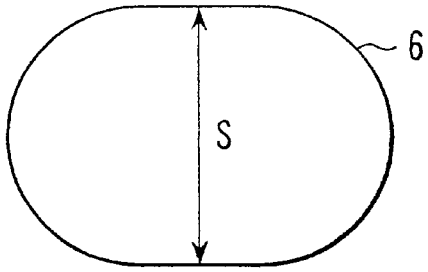
Figure 4C:
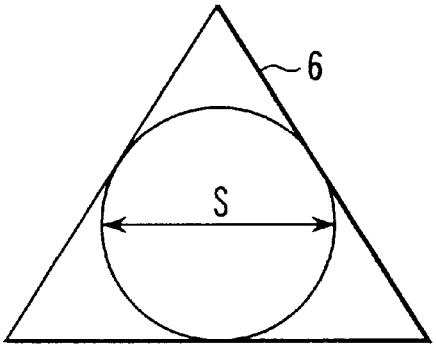
Figure 4D:
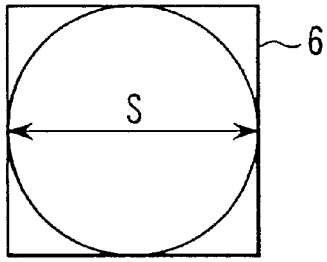
Figure 4E:
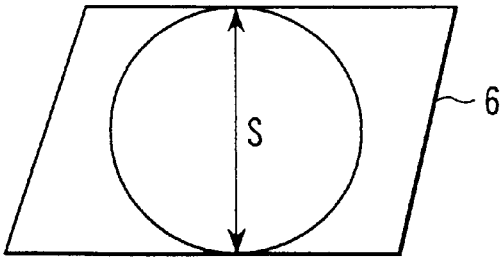
Figure 5A:
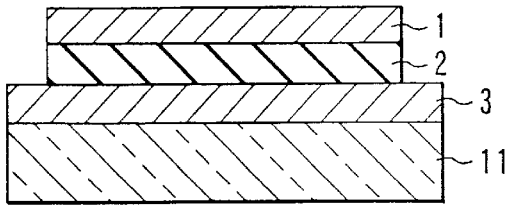
FIGS. 5A to 5F are cross-sectional views showing stages of a method of manufacturing a field emission device (display unit) according to the present invention.
Figure 5B:
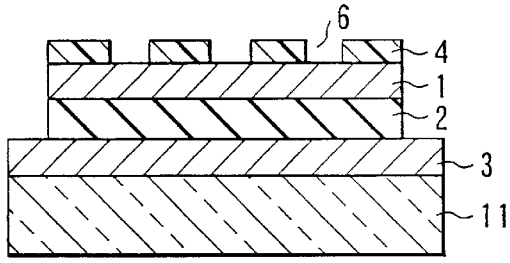

A laminated unit as shown in FIG. 5A is formed in the above manner. Next, openings 6 are formed on the gate electrode 1 and the insulation layer 2 as follows.

A resist 4 is coated on the surface of the gate electrode 1. The openings 6 are formed on the coated portion based on one of the following methods: an electron-beam exposure system, and a block copolymer phase-separation method (see U.S. patent application Ser. No. 09/588,721) for wet etching or a reactive ion etching (RIE) using an organic nano-structure as a mask.

In the present embodiment, masks are prepared using two kinds of methods. For a mask, an organic nano-structure is used based on the block copolymer phase-separation method. By using this mask, circular openings 6 are formed by the RIE on the resist 4 to have a diameter of about 40 nm to 100 nm for each opening. The resist spin-coating is also usable. Then, the spin-coated resist is aligned to form circular openings 6 (see FIG. 5B).

In the present embodiment, the aperture diameter and the height L of the insulation layer are fixed. Only the thickness Lg of the gate electrode is changed to stages of 50, 100, 150 and 200 nm. This is for carrying out an organoleptic test of changes in brightness based on changes in the thickness of the gate electrode.

After forming the openings 6 on the resist 4, the gate electrode 1 made of nickel is etched with a solution of iron (III) dichloride to form openings interconnected to the openings 6 of the resist 4, on the gate electrode.

Figure 5C:
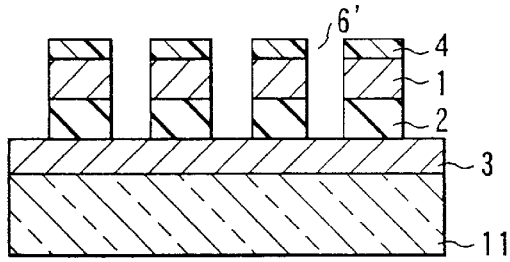
Figure 5D:
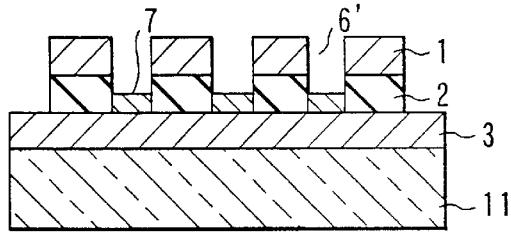

Further, a $CF_4$ gas is contacted to the insulation layer 2 made of $SiO_2$ via the openings of the gate electrode, so that openings interconnected to the openings of the gate electrode are also formed on the insulation layer 2. As a result, openings 6' are formed as shown in FIG. 5C.

Next, a solution having palladium compound particles dispersed in alcohol is dripped onto the openings 6'. Thus, the palladium compound particles are precipitated as a plane on the cathode 3 exposed on the openings 6'. The palladium compound particles are then dried in an inert atmosphere or a reducing atmosphere at 150° C. in the atmosphere. As a result, an electron emission layer 7 made of palladium is formed. Thereafter, the resist 4 is peeled off (see FIG. 5D).

While palladium is used as the emissive material 7 in the present embodiment, it is also possible to use other substance with a low work function such as Cs, $LaB_6$, graphite, carbon and diamond. In order to improve the electron emission efficiency, it is also possible to form carbon compound on the surface of the palladium particle, for example by sputtering or by CVD.

Figure 5E:
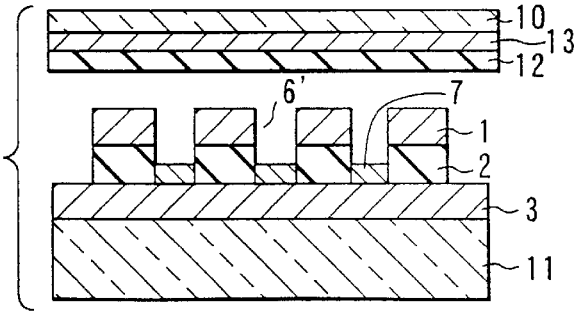
Figure 5F:
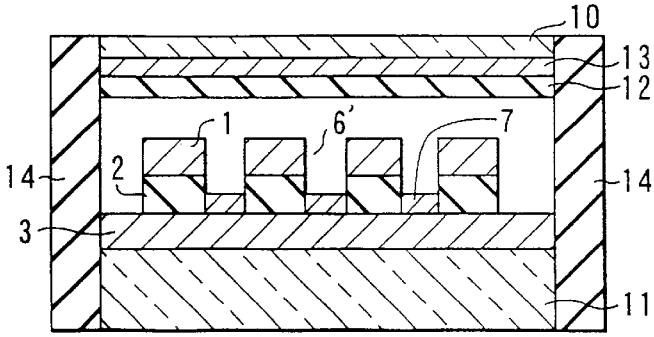

Further, above the substrate capable of emitting cold electrons, there is disposed a phosphor substrate consisting of a transparent glass 10, a transparent conductive film (ITO film) as an anode 13, and a phosphor layer 12, facing each other, as shown in FIG. 5E. Further, as shown in FIG. 5F, an area sandwiched between the cathode substrate having the cold cathode and the phosphor substrate is sealed airtight in a vacuum state by a frame 14. As a result, the field emission device (display unit) is completed.

The cathode of this field emission device is set to 0V, and voltages of 20 V and 5 V are applied to the gate electrode and the anode, respectively. Then, it has been confirmed that electrons emitted from the emissive material collide against the phosphor, and the phosphor emits light.

Figure 6:
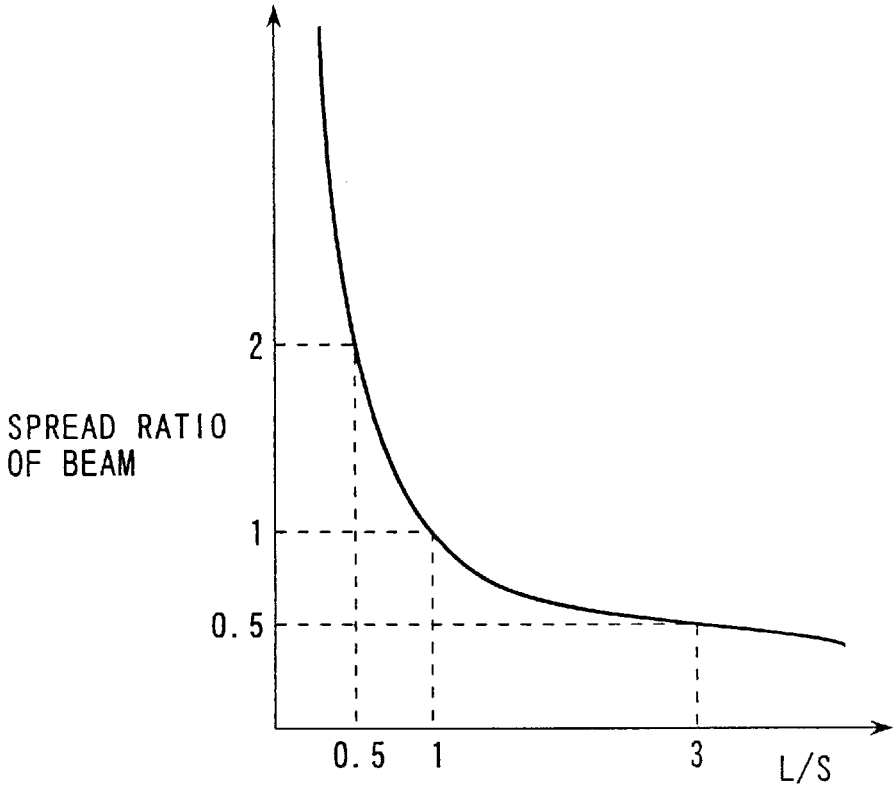
FIG. 6 is a diagram showing a relationship between a spread ratio of beams and a ratio of L to S, where L is a typical shortest passing distance of the electrons emitted from the emissive material to the gate electrode and S is an aperture diameter.
Figure 7:
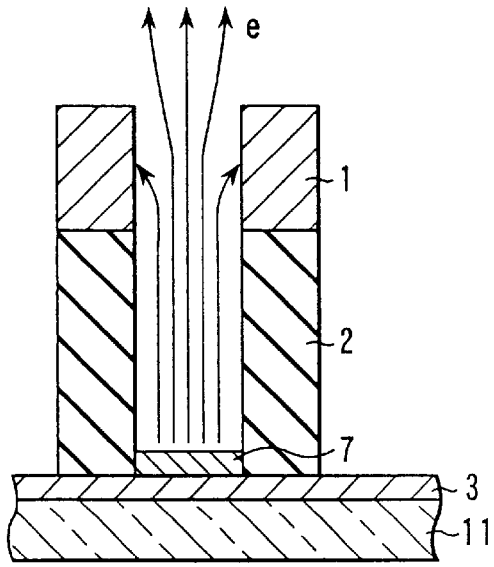
FIG. 7 is a schematic view showing an orbit of electrons of the emitter according to the present invention.

FIG. 6 shows a relationship between a spread ratio of electron beams emitted from the cathode and the L/S (the spread of L/S=1 is set as 1). As shown in FIG. 6, when L/S is equal to or above 1, the orbit of the electrons is controlled to become narrow. The reason of this control is considered as follows.

Based on the setting of the ratio of L/S to a large value, a majority of electrons emitted from the electron emitting-layer are drawn in a direction approximately vertical to the electron emitting-layer. Even if there exist electrons having a speed component in a direction parallel with the electron-emitting layer near the gate electrode, these electrons are absorbed by the gate electrode. As a result, only the electrons having the speed component in a direction approximately vertical to the electron emitting-layer pass through the openings of the gate electrode.

It has been assumed that an area in which the phosphor unit emits light is the size of the electron orbit.

According to the field emission device of the present invention, it is preferable that the average surface density of the openings including the electron emitters is 1 pc/$\mu m^2$ or above. This is because when the number of openings including the electron emitters is larger, the variance in the electron emission characteristics of each opening in averaged. Conventionally, there are cases that the average surface density is assumed as 4 pc/144 $\mu m^2$ (D. L. Lee, SID98 DIGEST, p589) or 9 pc/25 $\mu m^2$ (Yokowo, J. IEE Japan, vol. 112, No. 4, 1992, p257). Particularly, when the invention is to be applied to a display unit, the averaging of the variance is particularly effective for restricting the variance in pixel characteristics.

For obtaining a surface density of openings, the whole surface of the cathode is not used as a denominator. This denominator is defined as an area that covers the openings including the outermost electron emitters that exist on the same cathode within a portion where the gate electrode crosses with the cathode (see FIG. 8).

Figures 8, 9:
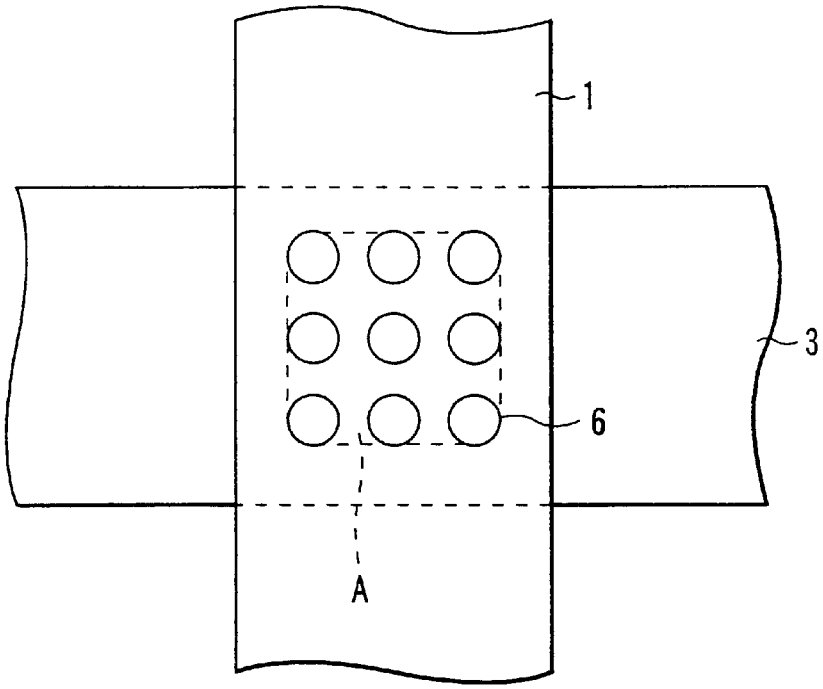
FIG. 8 is a schematic view for defining an area A that becomes a reference of a surface density of the opening according to the present invention.
FIG. 9 is a diagram showing a relationship between a ratio of a thickness Lg of a gate electrode to the shortest distance L and brightness of a display unit according to the present invention.

In the present invention, it is preferable that the ratio of a gate electrode thickness Lg to a shortest distance L meets a relationship of $Lg/L \leqq 0.75$. A result of carrying out the above-described organoleptic test of changes in brightness based on changes in the thickness of the gate electrode becomes as shown in FIG. 9. The brightness in the range of $Lg/L \leqq 0.75$ can meet the brightness of the display unit.

As explained above, according to the present invention, it is possible to provide a field emission device that can control the orbit of emitted electrons while employing a simple three-electrode structure.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A field emission device consisting of three electrodes, the field emission device comprising:

an emissive material formed on a cathode on a substrate;

an insulation layer formed to surround the emissive material;

a gate electrode formed on the insulation layer and having an opening for passing electrons emitted from the emissive material; and an anode opposing to the emissive material, wherein $L/S \geqq 1$, where S represents an aperture diameter of the opening, and L represents a typical shortest passing distance of the electrons emitted from the emissive material to the gate electrode.

2. The field emission device according to claim 1, wherein the field emission device has a plurality of openings, each being constituted of the openings, and the plurality of openings are formed in an average surface density of 1 pc/$\mu m^2$ or more than 1 pc/$\mu m^2$.

3. The field emission device according to claim 1, wherein a shape of the opening is a circle, and the aperture diameter is a diameter of the circle.

4. The field emission device according to claim 1, wherein a shape of the opening is an ellipse, and the aperture diameter is a short diameter of the ellipse.

5. The field emission device according to claim 1, wherein a shape of the openings is one of a triangle and a square, and the aperture diameter is a diameter of an inscribed circle of the one of the triangle and the square.

6. The field emission device according to claim 1, wherein a shape of the openings is a parallelogram, and the aperture diameter is a diameter of a circle that is inscribed to two longer parallel sides.

7. The field emission device according to claim 1, wherein the field emission device meets a relationship of $Lg/L \leqq 0.75$ where Lg represents a thickness of the gate electrode.

8. The field emission device according to claim 1, wherein the emissive material is flatly formed on the cathode, and includes at least one selected from the group consisting of Pd, Cs, $LaB_6$, graphite, carbon and diamond.

9. A field-emission type display unit essentially consisting of three electrodes, the field-emission type display unit comprising:

a substrate;

a cathode layer formed on the substrate;

an insulation layer formed on the cathode layer, and having a plurality of first openings;

a gate electrode formed on the insulation layer, and having a plurality of second openings corresponding to the plurality of first openings, each of the second openings having the same aperture diameter as that of each of the first openings;

an electron emission layer formed on the cathode layer exposed through the first and the second openings;

a transparent plate disposed to face a surface of the substrate on which the cathode layer is formed, via a frame provided on a periphery of the substrate;

an anode layer formed on a surface of the transparent plate facing a cathode layer; and a phosphor layer formed on the anode layer, wherein $L/S \geqq 1$, where S represents the aperture diameter of the plurality of first openings, and L represents a typical shortest passing distance of the electrons emitted from the emissive material to the gate electrode.

10. The field-emission type display unit according to claim 9, wherein the plurality of first openings are formed in an average surface density of 1 pc/$\mu m^2$ or more than 1 pc/$\mu m^2$.

11. The field-emission type display unit according to claim 9, wherein a shape of the plurality of first openings is a circle, and the aperture diameter is a diameter of the circle.

12. The field-emission type display unit according to claim 9, wherein a shape of the plurality of first openings is an ellipse, and the aperture diameter is a shorter diameter of the ellipse.

13. The field-emission type display unit according to claim 9, wherein a shape of the plurality of first openings is one of a triangle and a square, and the aperture diameter is a diameter of an inscribed circle of the one of the triangle and the square.

14. The field-emission type display unit according to claim 9, wherein a shape of the plurality of first openings is a parallelogram, and the aperture diameter is a diameter of a circle that is inscribed to two longer parallel sides.

15. The field-emission type display unit according to claim 9, wherein the field emission device meets a relationship of $Lg/L \leqq 0.75$ where Lg represents a thickness of the gate electrode and L represents the typical shortest distance.

16. The field-emission type display unit according to claim 9, wherein the emissive material is flatly formed on the cathode layer, and includes at least one selected from the group consisting of Pd, Cs, $LaB_6$, graphite, carbon and diamond.

17. The field-emission type display unit according to claim 9, wherein a space formed by the substrate, the transparent plate and the frame is kept under vacuum.

* * * * *